United States Patent [19]

Landry, Jr.

[11] 4,241,795

[45] Dec. 30, 1980

[54] HAND POWERED HIGH IMPACT TOOL

[76] Inventor: Ernest A. Landry, Jr., 50 Bennett St., Lynn, Mass. 01905

[21] Appl. No.: 912,423

[22] Filed: Jun. 5, 1978

[51] Int. Cl.[3] ..... B25C 1/02; B25D 9/04

[52] U.S. Cl. ..... 173/90; 173/132

[58] Field of Search ..... 173/90, 91, 126, 29, 173/118, 132; 30/277, 164.6; 81/52.35; 145/30.5; 29/275; 227/147; 279/19, 19.6; 52/155

[56] References Cited

U.S. PATENT DOCUMENTS

| | | | |
|---|---|---|---|
| 949,796 | 2/1910 | Howard | 173/126 |
| 1,229,732 | 6/1917 | Erickson | 30/277 |
| 1,605,435 | 11/1926 | Hansen | 173/133 X |
| 2,754,585 | 7/1956 | Green | 30/277 |
| 3,016,964 | 1/1962 | Schmidt | 173/132 X |
| 3,036,482 | 5/1962 | Kenworthy et al. | 173/90 |
| 3,244,426 | 4/1966 | Skoglund | 279/19 |
| 4,101,088 | 7/1978 | Stauth | 173/91 |

*Primary Examiner*—Werner H. Schroeder
*Assistant Examiner*—Andrew M. Falik
*Attorney, Agent, or Firm*—John N. Williams

[57] ABSTRACT

An impact tool capable of use in place of a conventional jackhammer, the tool being of the type having an axially moving impact member guided telescopically by a mating guide member, and characterized by the following combination:

(a) the impact member is a massive elongated rod, having a length of the order of two feet or greater, a diameter of the order of one inch or greater, and comprised of impact-resistant heavy material such as steel to have a weight of the order of 10 pounds;

(b) the guide member is a rigid hollow outer sleeve, having a slidable fit over the massive rod and having a lower end formation of internal shape corresponding to the external shape of the shank of a jackhammer tool bit;

(c) a restraint means retains the jackhammer tool bit with its shank inserted into the lower end formation of the guide; and (d) the massive rod and the guide member are cooperatively dimensioned so that the massive rod protrudes to enable a worker to alternately retract the massive rod and propel it against the end of the tool shank.

9 Claims, 4 Drawing Figures

HAND POWERED HIGH IMPACT TOOL

BACKGROUND OF THE INVENTION

This invention concerns impact tools useful in heavy work. It arises from the fact that conventional air or electric drive jackhammers such as used to break pavement are very expensive for situations where only a few blows are required. Also, as these tools require an air compressor or heavy electrical service, they have the serious disadvantage of extreme cumbersomeness. Sledgehammers and chisels are often not desirable substitutes because of being inaccurate and difficult to use. All of these tools are dangerous for the untrained.

SUMMARY OF THE INVENTION

It is an object of this invention to provide a tool which is inexpensive, practical, and safe, and still capable of deliverying very heavy, repeated blows and in a guided manner. Another object of the invention is to provide a new standard tool, sufficiently inexpensive to be included in the tool house supplies of every construction crew, and also suitable for low cost rental from tool rental businesses that service industry and the homeowner.

According to one important aspect of the invention, the new tool, which is of the known telescopically guided impact type, comprises a novel impact member in the form of a massive elongated rod having a length for instance of 2 or 3 feet or greater and a diameter of the order of one inch or greater and comprised of impact-resistant, heavy material such as steel with a weight of the order of 10 pounds. This massive rod is guided within a rigid hollow member having a lower end formation of internal shape to fit over the external shape of the shank of a conventional tool bit. Thus, in the preferred embodiment, the lower end of the guide is of hexagonal shape, matching standard tool bits which are already in stock in the construction crew tool shed or on the shelf in rental tool businesses. While the massive rod bears upon the end of the shank of such a retained tool within the guide member, the upper end of the massive rod protrudes from the guide member, to be grasped by a worker, who retracts it and then propels it against the end of the tool shank with great force. In preferred embodiments the guide member is a single length of hollow cylindrical pipe and the integral lower end of this pipe is deformed into the hexagonal shape.

Another feature of the invention is a restraint means for retaining the tool bit shank within the lower end of the guide member in a manner to permit temporary displacement of the tool bit downwardly relative to the guide member for a limited distance while under the influence of the impact of the massive member. Preferably this restraint means is elastic, enabling self-return of the tool bit to a fully seated position in the guide member. In the preferred form this restraint means comprises a heavy duty elastic band engaged upon a fitting carried by the guide member and about a fitting on the tool bit, e.g., a large elastomeric "O" ring which is simply looped about the flange on the shank of the standard tool bit.

The elastic restraint action allows gradual braking of the massive impact member when the tool bit does not encounter solid resistance. The upper end of the hexagonal formation of the guide provides a positive stop for the massive member after a predetermined amount of elastically-restrained travel, while the travel of the tool bit itself is controlled entirely by the elastic restraint.

Another feature of the invention is an upward movement stop comprising a spring detent follower located near the upper end of the guide member and riding upon the outer surface of the massive rod as it is withdrawn. The rod then has a cooperating detent formation near its lower end, into which the detent can fall to restrain further movement of the massive rod. This serves to avoid injury by preventing the massive rod from being dislodged from its guide member.

According to other aspects of the invention, impact tools of the general telescopically guided type are made more useful by provision of the elastic restraint means and the novel end formation to receive the shank of standard steel bits.

The above and other objects and features of the invention will be further described in conjunction with the drawings wherein:

DRAWINGS

Figure 2:
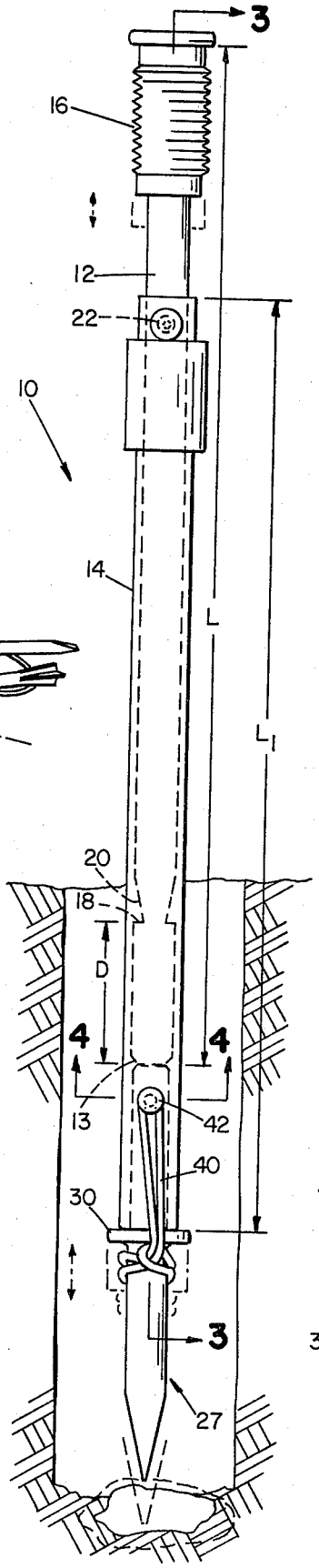
FIG. 2 is a side view on a larger scale of the tool of FIG. 1.
Figure 3:
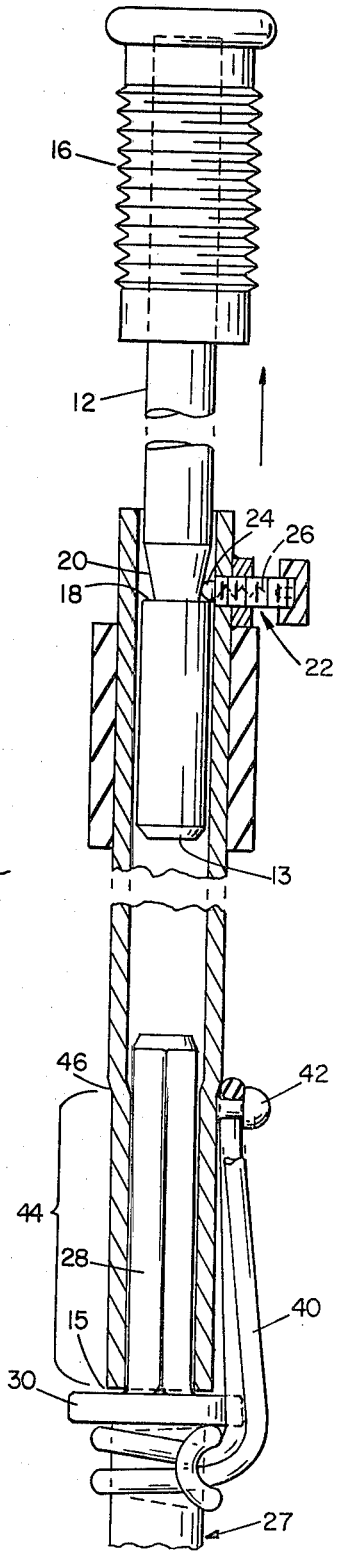
Figure 4:
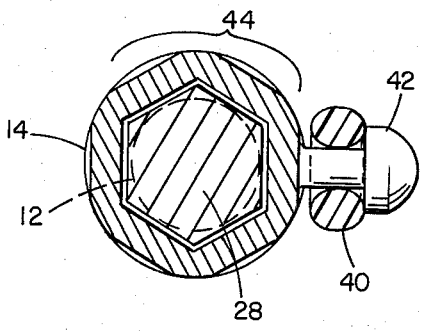

FIGS. 3 and 4 are cross-sectional views taken on lines 3—3 and 4—4 of FIG. 2 showing details of the construction of the preferred embodiment.

DESCRIPTION OF PREFERRED EMBODIMENT

Figure 1:
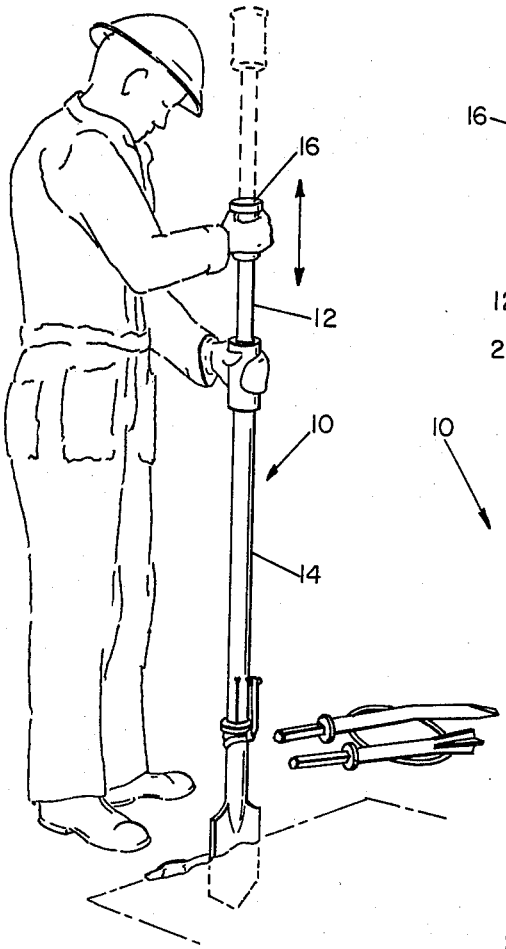
FIG. 1 is a perspective view illustrating a construction worker employing the impact tool of the present invention.

The manual jackhammer 10 of the invention is shown in FIG. 1 in the hands of a construction worker. Here the massive impact rod member 12 is grasped by handle 16 and slidably moved within the surrounding hollow guide member 14. The massive impact member 12 is a steel rod of constant cross-section of 1¼ inch O.D., has overall length L of 36 inches, and a weight of 12 pounds. As shown in FIG. 2, a hand grip, e.g., of plastic or rubber, is provided on its upper end and its lower impact end is chamfered at 13. Thus substantially all of the mass of the impact member is confined to the constant diameter rod. At a distance D, e.g., 4 inches, above the impact end of the massive rod, is a machined formation constituting an abrupt shoulder 18 and an upwardly enlarging conical surface 20 leading from the root of the abrupt shoulder upwardly to the full diameter of the rod. A spring loaded detent 22 is installed in the upper end of the guide 14. As seen from FIG. 3, this detent includes a ball-form follower 24 which is biased by spring 26 against the outer periphery of the rod 12. As the massive rod 12 is withdrawn, this ball 24 rides against the slope 20 and strikes shoulder 18, thereby preventing further outward movement of the massive rod 12, and preventing accidental dislodgement of the massive rod from its guide. It will be understood that this is an important safety feature in veiw of the heavy weight of the massive rod and its ability to injure someone if pulled completely out of guide 14. A threaded locking bolt is associated with the detent 22. By tightening this bolt, the ball may be tightly forced against the side of the rod 12 in collapsed position, to lock the rod and guide in this relation when not in use.

The guide 14 has an overall length $L_1$ of 34 inches and an inside diameter of 1½ inches. It is formed of steel pipe of hollow, cylindrical cross-section, having a wall thickness of 1/16 inch or greater and a weight of 5 pounds. so constructed, this guide member 14 has great resistance to bending, and can be used as a heavy pry-bar with the rod 12 in place.

The lower end of the guide member 14, over the last 5 inches, is specially formed to the internal hexagonal cross-section 44 shown in FIG. 4. This cross-sectional form mates with the external cross-sectional form of shank 28 of a standard jackhammer tool of nominal $1\frac{1}{8}$ inch hexagonal form. Shank 28 of the tool bit extends about six inches into the end of the guide member 14, and presents a champfered end face exposed for contact by end 13 of the massive impact rod, 1 inch above the end of the hexagonal formation of the guide. The standard tool 27 also includes an annular flange 30 which butts against the end 15 of the guide member. The working tip of the tool is selected as desired, for instance the pavement cutter tip shown in FIG. 1 or the chisel point shown in FIG. 2.

A novel elastic restraint is employed to hold the tool in place. As shown in FIGS. 2 and 3, this restraint comprises an elastic band 40 which is looped about the working end of the tool bit 27, just below flange 30, and then extends to a restraint 42, here shown as a rivet welded to the exterior of the guide member 14. The function of this restraint is first, to hold the standard jackhammer tool in position to receive the blow, and second, to allow movement of the tool bit relative to the guide under the influence of impact. Such movement does not occur if the tool bit tip is bearing upon a very rigid object. However, as depicted in FIG. 2, when the tool moves from the solid to the dotted line position, as may often happen when the tool breaks through the material which it is striking, the elastic restraint 40 permits movement of the tool bit relative to the guide and follow-through movement of the massive impact element, as it is progressively, elastically restrained. If movement proceeds for a distance of 1 inch, the end of the impact rod 12 is stopped by the top edge 46 of the hexagonal end formation 44 of the guide 14, while the tool bit itself is controlled entirely by the elastic restraint 40. These provisions enable restraint without undue stress on machanical parts and add to the ease with which the tool can be controlled. As soon as the impact movement has ended, the elastic restraint 40 is effective to return the tool bit to its seated position, simultaneously raising the impact rod 12 from engagement with the end 46 of the hexagonal formation 44.

The unit has a number of advantages which may not be readily apparent, further leading to safety in operation, safety in handling in closed position, and a minimum cross-sectional size for operation in restricted environments. Safety in operation is gained by the massive elongated rod shape of the impact member. By this construction the mass can be distributed uniformly over a long length, i.e., no mass concentration is required at any particular point along the length. Thus, at the critical time when the impact blow has been delivered to the tool bit, the mass of the tool is distributed in a balanced manner along the full length of the telescopically closed tool. This facilitates positive control of the tool by the hands of the worker at this critical time. Furthermore, the point of transfer of impact between the massive rod and the tool shank is shielded by the guide, so that any dislodged steel particles at the point of energy exchange between these two steel members can not reach the worker.

Safety in handling is achieved by the balanced distribution of mass of the tool in the closed, locked position, as a result of the mass being distributed throughout the length of the tool.

Minimum cross-sectional size of the unit is made possible by the internal rod form of the impact member. This distributes the large mass over the long length of the tool, and avoids need for any enlarged cross-sectional portions. Also, by the combination of the rod-form massive member and the internal positioning of the entire cross-section of the tool bit, the cross-section of all operative elements is kept small. Also, by such an arrangement, substantial correspondence in area of the colliding elements is obtained, with efficient energy transfer, and a minimization of the tendency to deform. By thus reducing the tendency to deform, a long life for both the impact member and the tool is made possible in a jackhammer action tool occupying a small cross-sectional area.

The tool as described has many uses. The full range of standard jackhammer tool bits can be employed, for instance asphalt cutters, various points, chisels, frost wedges and digging chisels. The tool can also be used as an emergency tool by firemen to force open heavy locked doors. The tool has particular utility in remote spaces such as small-size holes, as depicted in FIG. 2, where it may be useful to breakup or move aside boulders encountered during the digging of such holes.

It will be appreciated that the tool of this invention is formed of standard materials, which have long been available to the toolmaker and certainly would have been so employed had the concept of the present invention been known. The impact rod 14 may be formed of readily available high-strength steel while the guide member can be ordinary steel pipe. The special formation at the lower end of the guide member can be provided by insertion of the pipe into a suitable die in a conventional heavy press. The elastic member 40 is preferably provided in the form of a standard O ring of approximately 6 inch unstressed diameter and with a ring thickness of approximately $\frac{1}{4}$ inch.

From the foregoing it will be understood that the invention provides an imminently practical tool and has features which enable safe dependable action as a substitute for a compressor-powered jackhammer. The invention also presents features having use in other axial impact tools as well.

What is claimed is:

1. A hand-powered tool for use with a conventional jackhammer tool bit to deliver high impact axial blows to said bit, said bit being of the type including a noncylindrical upper blow-receiving shank, a blow-transmitting working end, and an integral annular protrusion between said upper shank and said working end, said protrusion being spaced from the upper end of said bit by the axial length of said upper shank, said hand-powered tool comprising:

an impact rod, said rod having a length of the order of two feet or greater and a diameter of the order of one inch or greater, said rod being comprised of impact-resistant heavy material such as steel to have a weight of the order of ten pounds, and said rod including a hand grippable upper end and a lower end shaped for impacting the upper end of said bit, a tubular guide member, said member including a bit guiding surface comprising a noncylindrical interior surface shaped to telescopically receive and thereby prevent rotation of said noncylindrical upper shank of said bit, said bit guiding surface extending upward from a lower end of said member by a length less than said length of said bit shank, so that when said bit is installed in the lower end of said member, with said bit protrusion resting against said lower end of said member, the shank protrudes above said bit guiding surface, a rod guiding surface comprising a cylindrical interior surface sized to telescopically receive said rod, said rod guiding surface extending downward from an upper end of said member and merging with said bit guiding surface and said rod guiding surface being shorter axially than said rod so that said hand grippable upper end protrudes from said guide member when said rod is installed and its lower end bears upon said bit, and restraint means for retaining said bit within said guide member, said restraint means including an element suitable for connection to the lower end of said guide member and to said bit at a location below said protrusion.

2. The impact tool of claim 1 wherein said restraint means is elastic, enabling self-return of said tool bit to a fully seated position in said guide member upon termination of impact movement of said massive member.

3. The impact tool of claim 1 or 2 wherein said elastomeric element comprises a heavy duty elastic band member engaged upon a fitting carried by said guide member and adapted to be secured about a fitting on said tool bit.

4. The impact tool of claim 3 adapted for use with a conventional jackhammer tool bit which has a flange at the lower end of its mounting shank, said fitting on said guide member and the length of said heavy duty elastic band member cooperatively arranged to enable said band member to be secured about said flange.

5. The impact tool of claim 3 wherein said elastic band member comprises an elastomeric O ring.

6. An impact tool capable of use in place of a conventional jackhammer, said tool being of the type having an axially moving impact member guided telescopically by a mating guide member, and characterized by the following combination:

(a) said impact member being an elongated rod, having a length of the order of two feet or greater, a diameter of the order of one inch or greater, a hand grippable upper end, and comprised of impact-resistant heavy material such as steel to have a weight of the order of 10 pounds;

(b) said guide member being a rigid hollow sleeve, having a slideable fit with said elongated rod and having a lower end formation of internal shape corresponding to the external shape of the shank of a tool bit;

(c) resilient restraint means to retain said tool bit with its shank inserted into said lower end formation, said restraint means comprising an elongated elastomeric element removably secured at one end to the exterior of said guide member and at its other end to the exterior of the tool bit, said element arranged to be elastically stretched during a blow of said elongated rod on said tool bit, and upon completion of said blow adapted to elastically retract said tool bit relative to said tubular member to its initial position, ready to receive a further blow; and (d) said elongated rod and said guide member cooperatively dimensioned so that when said rod bears upon the end of the shank of a retained tool, said rod protrudes beyond the upper end of said guide to be gripped to enable a worker to alternately retract said rod and propel it against the end of said tool shank.

7. The impact tool of claim 6 adapted for use with a standard jackhammer tool having a hexagonal cross-section wherein the lower end of said guide is formed into a hexagonal cross-section.

8. The impact tool according to claim 1 including locking means effective to lock said rod and guide member in telescopically closed position when not in use, and to limit outward movement of said rod when in use.

9. An impact tool capable of use in place of a conventional jackhammer, said tool being of the type having an axially moving impact member guided telescopically by a mating guide member, and characterized by the following combination:

(a) said impact member being an elongated rod, having a length of the order of two feet or greater, a diameter of the order of one inch or greater, a hand grippable upper end, and comprised of impact-resistant heavy material such as steel to have a weight of the order of 10 pounds;

(b) said guide member being a rigid hollow sleeve, having a slidable fit with said elongated rod and having a lower end formation of internal shape corresponding to the external shape of the shank of a jackhammer tool bit;

(c) restraint means to retain said jackhammer tool bit with its shank inserted into said lower end formation;

(d) said elongated rod and said guide member cooperatively dimensioned so that when said rod bears upon the end of the shank of a retained tool, said rod protrudes beyond the upper end of said guide to be gripped to enable a worker to alternately retract said rod and propel it against the end of said tool shank; and (e) stop means for preventing full retraction of said massive rod from said guide member comprising a spring detent follower located near the upper end of said guide member and riding upon the outer surface of said massive rod as it is withdrawn, said rod having a cooperating detent formation near its lower end into which said detent can fall to restrain further movement of said rod.

* * * * *